US009556553B2

(12) United States Patent
Liu et al.

(10) Patent No.: US 9,556,553 B2
(45) Date of Patent: Jan. 31, 2017

(54) SPIN-DRYER

(71) Applicant: GREAT-EAGLE TECHNOLOGIES CO., LTD., Taichung (TW)

(72) Inventors: Hsuan-Yu Liu, Taichung (TW); Nai-Te Liu, Taichung (TW); Yu-Sheng Chen, Taichung (TW)

(73) Assignee: Great-Eagle Technology Co., Ltd., Taichung (TW)

( * ) Notice: Subject to any disclaimer, the term of this patent is extended or adjusted under 35 U.S.C. 154(b) by 70 days.

(21) Appl. No.: 14/613,623

(22) Filed: Feb. 4, 2015

(65) Prior Publication Data

US 2015/0233044 A1 Aug. 20, 2015

(30) Foreign Application Priority Data

Feb. 14, 2014 (TW) ..... 103202632 U

(51) Int. Cl.
*F26B 5/08* (2006.01)
*D06F 58/08* (2006.01)
*D06F 49/04* (2006.01)

(52) U.S. Cl.
CPC ..... *D06F 58/08* (2013.01); *D06F 49/04* (2013.01)

(58) Field of Classification Search
CPC ..... F26B 5/00; F26B 5/08; D06F 8/00; D06F 58/08
USPC ..... 34/58; 68/20
See application file for complete search history.

(56) References Cited

U.S. PATENT DOCUMENTS 1,675,076 A * 6/1928 Wurfflein ..... F26B 7/00 34/188
1,880,273 A * 10/1932 Pardee ..... F26B 17/104 209/11
1,889,761 A * 12/1932 Schlesinger ..... A42C 1/08 134/86
1,931,749 A * 10/1933 Bigsby ..... F26B 11/0445 34/108
2,463,842 A * 3/1949 Woods ..... D06F 49/06 248/200.1
2,784,500 A * 3/1957 Beaumont ..... D06F 37/12 34/58
2,826,826 A * 3/1958 Boehm ..... B44D 3/006 34/58
4,412,390 A * 11/1983 Grant ..... D06F 49/003 188/166
4,897,933 A * 2/1990 Ito ..... A47L 15/4259 34/322

(Continued)

FOREIGN PATENT DOCUMENTS

DE CH 481680 A * 11/1969 ..... B04B 1/20
FR 1551383 A * 12/1968 ..... F02C 9/263

(Continued)

*Primary Examiner* — Stephen M Gravini

(57) ABSTRACT

A spin-dryer includes an external drum, an internal drum and a spinning unit. The external drum includes a containing chamber. The internal drum is rotationally inserted in the containing chamber. The internal drum includes a spinning chamber, apertures in communication with the spinning chamber, and a lower axle rotationally inserted in the external drum. The spinning unit includes a motor inserted in the external drum, a driver gear operatively connected to the motor, and a follower gear connected to the lower axle and engaged with the driver gear.

11 Claims, 6 Drawing Sheets

(56) References Cited

U.S. PATENT DOCUMENTS

| | | | | | |
|---|---|---|---|---|---|
| 5,577,331 | A * | 11/1996 | Suzuki | F26B 5/08 | 34/58 |
| 5,611,150 | A * | 3/1997 | Yore, Jr. | B29B 9/16 | 34/128 |
| 5,974,681 | A * | 11/1999 | Gonzalez-Martin | H01L 21/67034 | 34/58 |
| 7,028,415 | B2 * | 4/2006 | Heinzen | F26B 5/08 | 34/312 |
| 8,910,392 | B2 * | 12/2014 | Liao | F26B 5/08 | 119/850 |
| 2010/0180460 | A1 * | 7/2010 | Tang | A47L 13/50 | 34/58 |
| 2015/0233044 | A1 * | 8/2015 | Liu | D06F 49/04 | 34/108 |
| 2016/0146536 | A1 * | 5/2016 | Hoffman | F26B 5/08 | 34/58 |

FOREIGN PATENT DOCUMENTS

| | | | | |
|---|---|---|---|---|
| GB | 1488500 A | * | 10/1977 | B01D 46/26 |
| RU | 2104802 C1 | * | 2/1998 | |

* cited by examiner

SPIN-DRYER

BACKGROUND OF INVENTION

1. Field of Invention

The present invention relates to a spin-dryer and, more particularly, to a structurally simple spin-dryer for quickly spin-drying and sterilizing towels to improve personal hygiene.

2. Related Prior Art

People wet towel when they take showers. To dry the towels after the showers, people generally twist the towels to squeeze water out of them and then just air-dry them. However, the twisting is inadequate for squeezing the water out of the towels, particularly when they are large and thick. Moreover, air-drying is insufficient if a towel is left in a bathroom which is generally humid for not including a window, particularly in an urban area. Hence, the towels remain wet for long periods of time, and fungus and bacteria grow in the towels and the towels get dirty and stinky.

A washer/dryer can of course be used to spin-dry towels. However, a washer/dryer is often too bulky for a bathroom which is generally small, particularly in an urban area. Moreover, it is a waste to use a washer/dryer to spin-dry towels only. With all these factors considered, it is not practical for a user to spin-dry a towel after a shower every time.

The present invention is therefore intended to obviate or at least alleviate the problems encountered in prior art.

SUMMARY OF INVENTION

It is an objective of the present invention to provide an efficient spin-dryer for small textiles such as towels to facilitate subsequent air-drying to improve personal hygiene.

It is another objective of the present invention to provide an operationally stable spin-dryer to improve convenience and workability.

To achieve the foregoing objectives, the spin-dryer includes an external drum, an internal drum and a spinning unit. The external drum includes a containing chamber. The internal drum is rotationally inserted in the containing chamber. The internal drum includes a spinning chamber, apertures in communication with the spinning chamber, and a lower axle rotationally inserted in the external drum. The spinning unit includes a motor inserted in the external drum, a driver gear operatively connected to the motor, and a follower gear connected to the lower axle and engaged with the driver gear.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
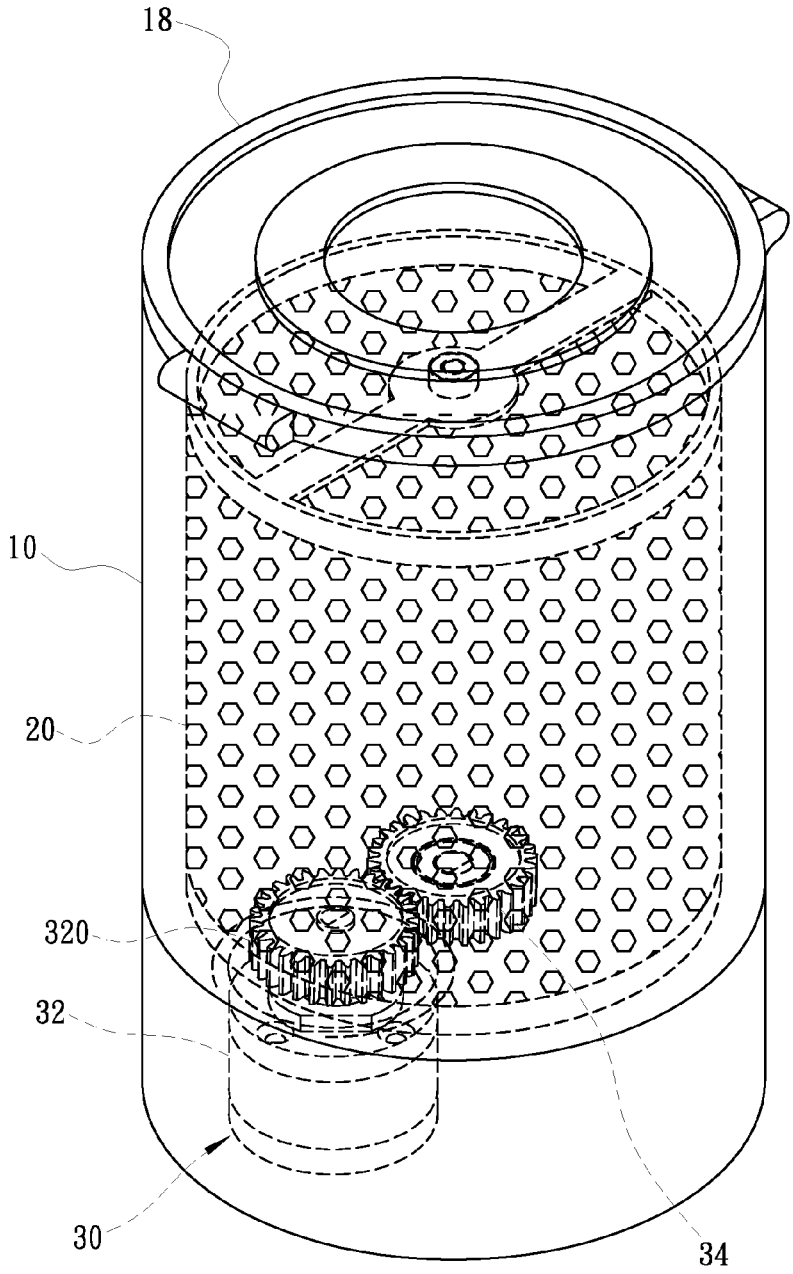
FIG. 1 is a perspective view of a spin-dryer according to the first embodiment of the present invention.
Figure 2:
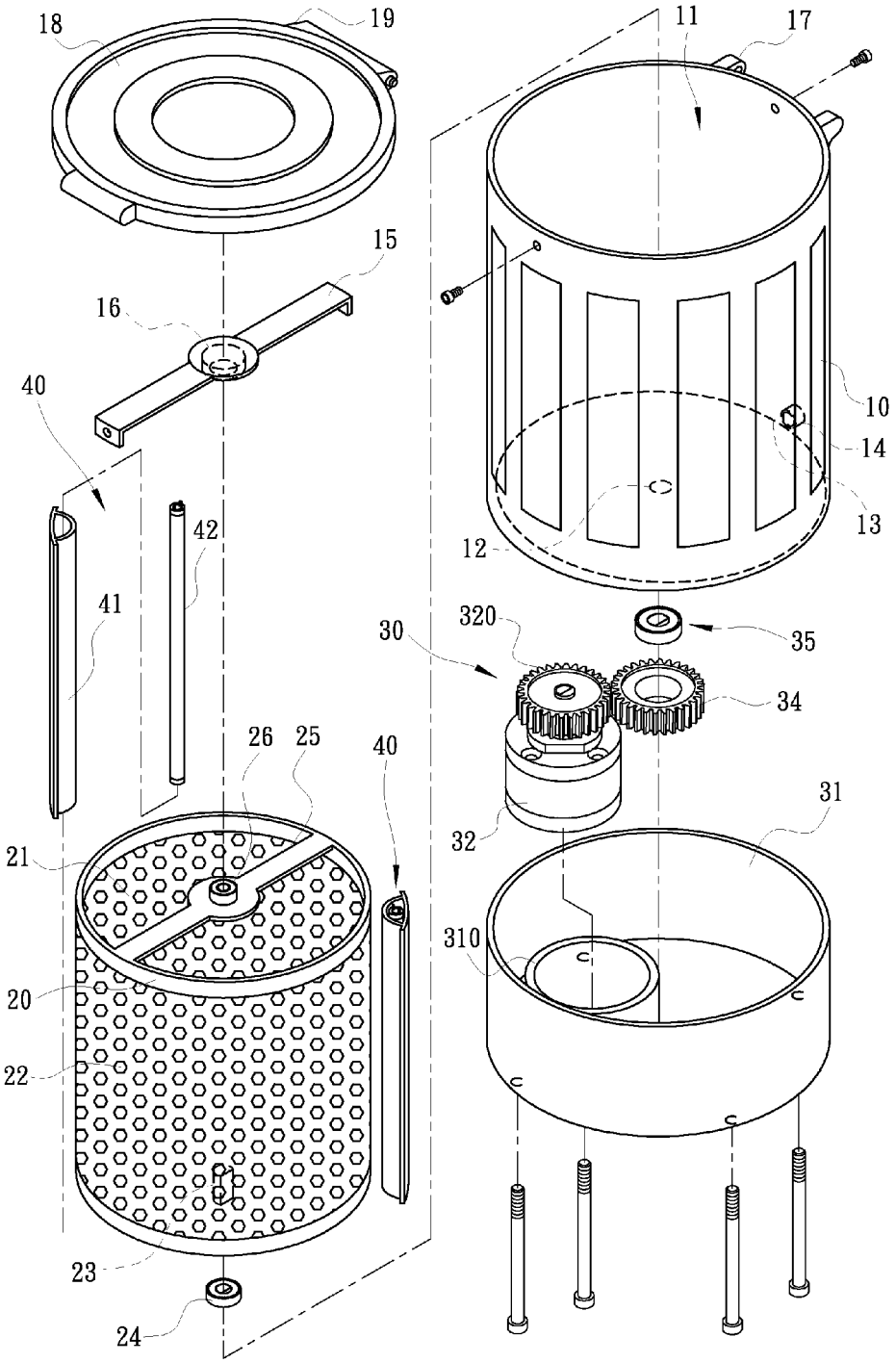
FIG. 2 is an exploded view of the spin-dryer shown in FIG. 1.
Figure 3:
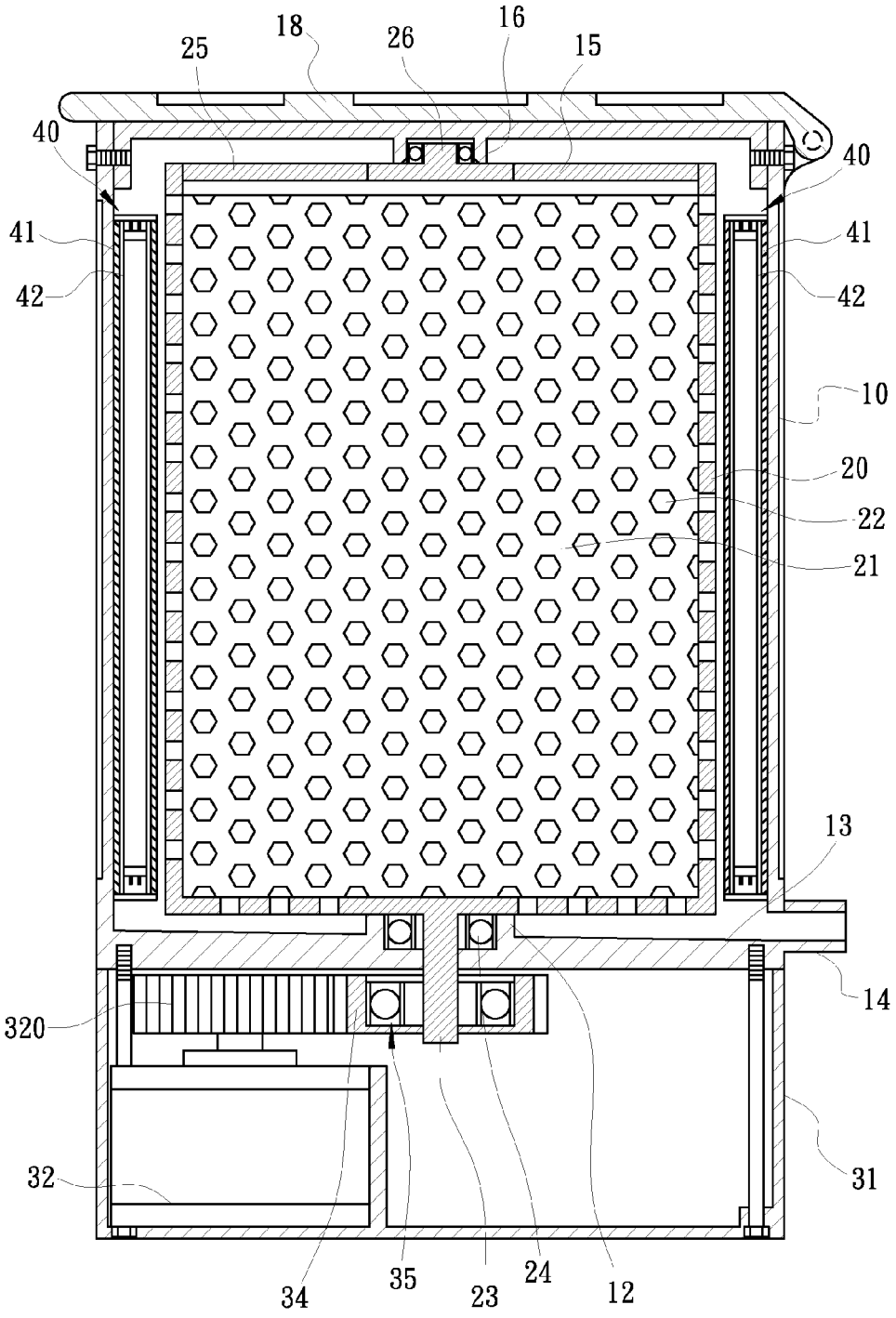
FIG. 3 is a cross-sectional view of the spin-dryer shown in FIG. 1.

Referring to FIGS. 1 to 3, a spin-dryer includes an external drum 10, an internal drum 20 rotationally inserted in the external drum 10, and a spinning unit 30 for spinning the internal drum 20 at high speed according to a first embodiment of the present invention.

The external drum 10 includes a containing chamber 11, a socket 12, a drip pan 13, a drain 14, a beam 15, a socket 16 and two lugs 17. The containing chamber 11 includes an opening at an upper end. The socket 12 is formed at a center of a lower end of the external drum 10. The socket 12 extends throughout the lower end of the external drum 10. The drip pan 13 is formed at the lower end of the external drum 10. The drip pan 13 is located below the containing chamber 11. The drip pan 13 tilts towards the drain 14. The drain 14 is located at the lowest point of the drip pan 13. The drip pan 13 is in communication with the exterior of the external drum 10 via the drain 14. The beam 15 bridges the opening at the upper end of the containing chamber 11. The socket 16 extends from a lower face of the beam 15 towards the socket 12. The lugs 17 are formed on the external drum 10, near the upper end.

A lid 18 is formed with two pivots 19. Each of the pivots 19 is inserted in and supported on a corresponding one of the lugs 17. Thus, the lid 18 is pivotally connected to the external drum 10. The lid 18 is used to open and close the containing chamber 11.

The internal drum 20 includes a spinning chamber 21, apertures 22, an axle 23, a bearing 24, a beam 25 and another axle 26. The spinning chamber 21 is centrally made in the internal drum 20 and includes an opening at an upper end. The apertures 22 are made in a wall and a floor of the internal drum 20. Water can be cast into the containing chamber 11 of the external drum 10 from the spinning chamber 21 of the internal drum 20 through the apertures 22. The axle 23 extends from a lower face of the floor of the internal drum 20. The axle 23 is rotationally inserted in the socket 12 of the external drum 10 via the bearing 24. The axle 23 extends throughout the floor of the external drum 10. The axle 23 is connected to and driven by the spinning unit 30. The beam 25 bridges the opening at the upper end of the spinning chamber 21. The axle 26 extends from an upper face of the beam 25. The axle 26 is rotationally inserted in the socket 16, which extends from the lower face of the beam 15 of the external drum 10. Thus, the internal drum 20 can spin in the external drum 10, fast and stably.

The spinning unit 30 includes a bowl 31, a motor 32, a driver gear 320, a follower gear 34 and a one-way element 35. The bowl 31 is connected to the lower end of the external drum 10. A motor mount 310 is formed on an upper face of the bowl 31. The motor 32 is inserted in or supported on the motor mount 310. The driver gear 320 is connected to an axle or mandrel of the motor 32. Via the one-way element 35, the follower gear 34 is connected to the axle 23, which extends into the bowl 31 from the external drum 10 through the internal drum 20. The one-way element 35 can be, but not limited to, a one-way bearing or ratchet bearing. Thus, the driver gear 320, which is operatively connected to the motor 32, spins the follower gear 34 in a one-way manner. Then, the axle 23, which is operatively connected to the follower gear 34, spins the internal drum 20.

In another embodiment, the driver gear 320 and the follower gear 34 can be replaced with two pulleys operatively connected to each other via a belt.

Moreover, a sterilizing module 40 is used in the external drum 10. The sterilizing module 40 includes a lens 41 attached to an internal face of the external drum 10. A sterilizing light tube 42 is inserted in and supported by the lens 41. The sterilizing light tube 42 can be, but not limited to, an ultraviolet light tube or a photo catalyst.

Figure 4:
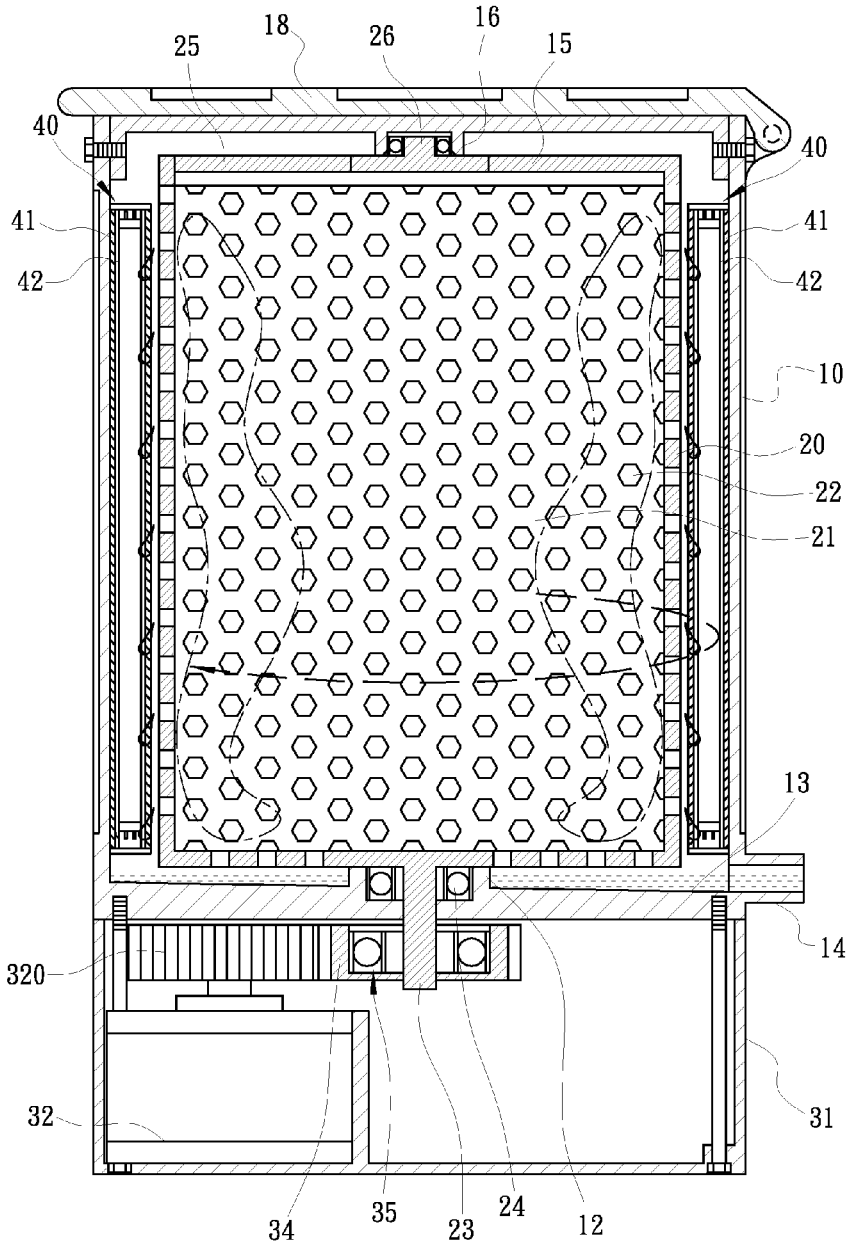
FIG. 4 is a cross-sectional view of the spin-dryer in a working status other than a stand-by status shown in FIG. 3.

Referring to FIGS. 1, 3 and 4, in operation, to spin-dry textiles such as towels and socks, the lid 18 is lifted from the spin-dryer external drum 10 and the textiles are cast into the spinning chamber 21 of the internal drum 20. Then, the motor 32 of the spinning unit 30 is actuated. The motor 32 spins the internal drum 20 via the engagement of the driver gear 320 with the follower gear 34, which is connected to the axle 23. Thus, the motor 32 rotates the internal drum 20 at high speed to cast water out of the textiles. The water travels into the external drum 10 from the internal drum 20 via the apertures 22. Thus, the textiles are cast-dried. The water drips into or onto the drip pan 13 connected to the lower end of the external drum 10. Finally, the water flows out of the drip pan 13 via the drain 14. Thus, only a little water is left in the textiles, and the textiles can easily be air-dried. Accordingly, not much fungus and bacteria grow in the textiles, and the textiles do not smell. Therefore, personal hygiene is improved.

Moreover, the sterilizing light tube 42 of the sterilizing module 40 can be actuated during or after the spin-drying operation. The sterilizing light tube 42 emits light to further suppress the growth of the fungus and bacteria. The personal hygiene is further improved.

Figure 5:
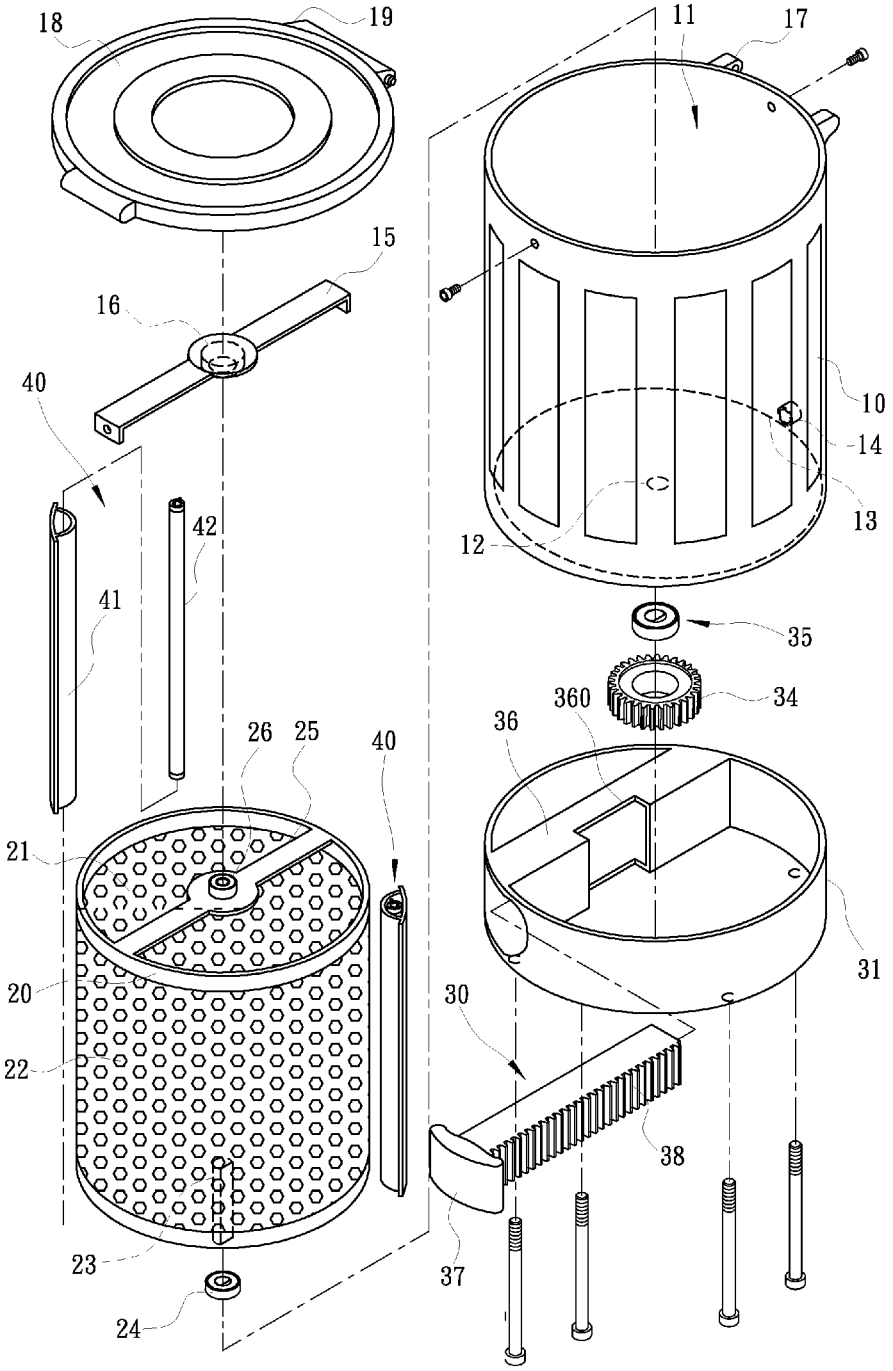
FIG. 5 is an exploded view of a spin-dryer according to the second embodiment of the present invention.
Figure 6:
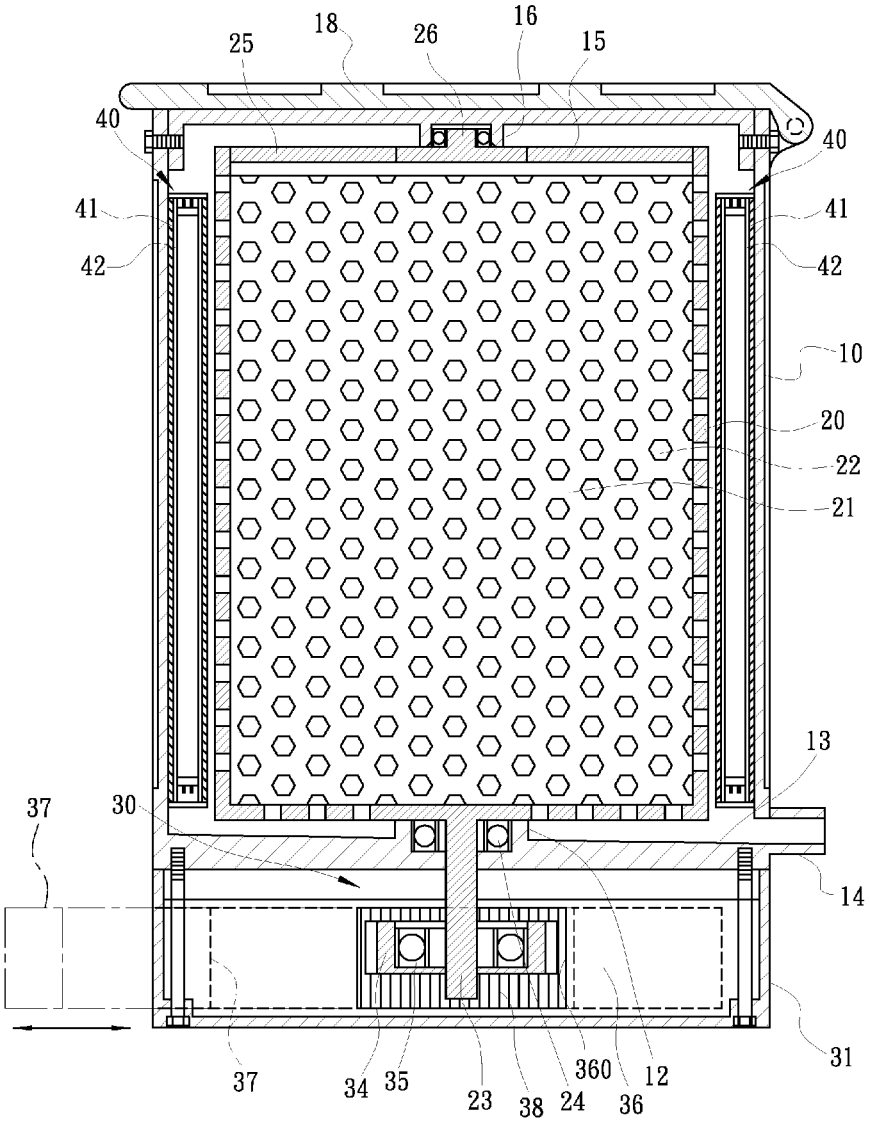
FIG. 6 is a cross-sectional view of the spin-dryer shown in FIG. 5.

Referring to FIGS. 5 and 6, there is a spin-dryer according to a second embodiment of the present invention. The second embodiment is like the first embodiment except for several things. Firstly, the spinning unit 30 includes a rack 37 instead of the motor 32 and the driver gear 320. Secondly, the bowl 31 includes a track 36 instead of the motor mount 310. The track 36 includes a cutout 360 corresponding to the follower gear 34, which is connected to the axle 23 via the one-way element 35. The rack 37 is movably inserted in the track 36. The rack 37 includes teeth 38 engaged with teeth of the follower gear 34. The teeth 38 are exposed to the follower gear 34 via the cutout 360. Thus, a user can alternately pull and push the rack 37 to manually drive the axle 23 in a one-way manner. In turn, the axle 23 spins the internal drum 20.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A spin-dryer including:

an external drum including a containing chamber;

an internal drum rotationally inserted in the containing chamber, wherein the internal dram includes a spinning chamber, apertures in communication with the spinning chamber, and a lower axle rotationally inserted in the external drum; and a spinning unit including a motor inserted in the external drum, a driver gear operatively connected to the motor, and a follower gear connected to the lower axle and engaged with the driver gear;

a sterilizing module including a lens inserted in and connected to the external dram and a sterilizing light tube inserted in the lens.

2. The spin-dryer according to claim 1, wherein the external drum includes a drain in communication with the containing chamber and a drip pan located below the containing chamber and tilted towards the drain.

3. The spin-dryer according to claim 1, wherein the external drum includes a beam bridging the containing chamber and a socket extending from the beam, and the internal drum includes a beam bridging the spinning chamber and an upper axle extending from the beam thereof, and the upper axle is inserted in the socket.

4. The spin-dryer according to claim 1, further including a lid with two pivots, wherein the external drum includes two lugs for receiving the pivots so that the lid is pivotally connected to the external drum and operable for closing and opening the containing chamber of the external drum.

5. The spin-dryer according to claim 1, wherein the spinning unit includes a one-way element arranged between the follower gear and the lower axle so that the spinning unit is operable to spin the internal drum in a one-way manner at high speed.

6. A spin-dryer including:

an external drum including a containing chamber;

an internal drum rotationally inserted in the containing chamber, wherein the internal drum includes a spinning chamber, apertures in communication with the spinning chamber, and a lower axle rotationally inserted in the external drum; and a spinning unit including:

a track formed in the external drum and made with a cutout corresponding to the lower axle;

a rack movably inserted in the track; and a follower gear connected to the lower axle and engaged with the rack through the cutout.

7. The spin-dryer according to claim 6, wherein the external drum includes a drain in communication with the containing chamber and a drip pan located below the containing chamber and tilted towards the drain.

8. The spin-dryer according to claim 6, wherein the external drum includes a beam bridging the containing chamber and a socket extending from the beam, and the internal drum includes a beam bridging the spinning chamber and an upper axle extending from the beam thereof, and the upper axle is inserted in the socket.

9. The spin-dryer according to claim 6, further including a lid with two pivots, wherein the external drum includes two lugs for receiving the pivots so that the lid is pivotally connected to the external drum and operable for closing and opening the containing chamber of the external drum.

10. The spin-dryer according to claim 6, wherein the spinning unit includes a one-way element arranged between the follower gear and the lower axle so that the spinning unit is operable to spin the internal drum in a one-way manner at high speed.

11. The spin-dryer according to claim 6, further including a sterilizing module inserted in the external drum, wherein the sterilizing module includes a lens inserted in and connected to the external drum and a sterilizing light tube inserted in the lens.

* * * * *